United States Patent [19]

Thompson et al.

[11] Patent Number: 4,932,729

[45] Date of Patent: Jun. 12, 1990

[54] DOOR HINGE AND CABINET SUPPORT MOUNTING BRACKET

[75] Inventors: Thomas R. Thompson, Adneson, S.C.; Max E. Gibbs, Belding; Darwin K. House, Greenville, both of Mich.

[73] Assignee: White Consolidated Industries, Inc., Cleveland, Ohio

[21] Appl. No.: 434,457

[22] Filed: Nov. 13, 1989

[51] Int. Cl.[5] ..... A47B 91/00

[52] U.S. Cl. ..... 312/256; 312/254; 312/214; 248/188.2

[58] Field of Search ..... 312/250, 253-256, 312/236, 214; 248/188.2, 188.4

[56] References Cited

U.S. PATENT DOCUMENTS

| | | | |
|---|---|---|---|
| 849,999 | 4/1907 | Hendricks | 312/250 |
| 2,171,852 | 9/1939 | Klute | 312/256 |
| 2,803,510 | 8/1957 | Carbary | 248/188.2 X |
| 3,948,410 | 4/1976 | Anderson | 312/214 |
| 3,967,868 | 7/1976 | Baker | 312/250 X |
| 4,170,391 | 10/1979 | Bottger | 312/214 |
| 4,763,866 | 8/1988 | Teich | 248/188.2 X |
| 4,783,879 | 11/1988 | Weaver | 16/34 |

*Primary Examiner*—Joseph Falk

*Attorney, Agent, or Firm*—Pearne, Gordon, McCoy & Granger

[57] ABSTRACT

A refrigerator cabinet includes an outer metal shell supported on a separate base member having inwardly extending upper and lower flanges. The upper flange is secured to the bottom of said shell and a U-shaped bracket member is mounted in each corner of said base member to have an intermediate vertical portion abutting the vertical wall of said base member while upper and lower wall portions of the bracket member extend adjacent the upper and lower base flanges. A door is mounted on the front of the cabinet by hinge means including a lower hinge bracket which is clamped by fasteners through the base front wall to the intermediate portion of the bracket member. The lower wall of the bracket member serves to support a threaded leveling leg, while the upper wall of the bracket member serves to give pivotal support to a roller carrier which may be raised and lowered by an adjusting screw extending through the front wall of the base.

18 Claims, 5 Drawing Sheets

DOOR HINGE AND CABINET SUPPORT MOUNTING BRACKET

BACKGROUND OF THE INVENTION

This invention relates generally to refrigerator cabinets, and more particularly to a mounting bracket for attaching a hinge plate and a support member such as a leveling leg or roller directly on the sheet metal cabinet.

A refrigerator cabinet requires a certain amount stiffness and rigidity, not only because the refrigerator itself may weigh several hundred pounds but also because the contents may also be fairly heavy, the refrigerator is subject to continued stress from the opening and closing of the doors, and the refrigerator itself must be movable across the floor for cleaning purposes. In order to achieve proper operation of the door, the hinge assembly must be precisely mounted to allow proper sealing of the gasket around the door, while the cabinet must be leveled on the floor for proper door opening and closing. The latter requires the presence of either screw-adjustable leveling legs or adjustable rollers as options available to the user.

The problem has been complicated by changes in refrigerator design. The use of foamed-in-place insulation, while adding greatly to the rigidity of the cabinet, has allowed the use of much thinner sheet metal. While the use of thinner metal has also reduced the cabinet weight, the construction requires that in some locations, the metal must be reinforced to provide the necessary stiffness and rigidity for the cabinet.

This matter has been further complicated by the increasing use of pre-finished and pre-painted sheet metal, particularly for the exterior panels of the cabinet, since the use of such sheet metal means that welding and similar methods cannot be used but that the fastening together of the various parts must therefore rely entirely upon mechanical connections.

In cabinets of this type, the bottom portion of the cabinet which covers the insulation must be spaced a certain distance above the floor to allow air circulation beneath the cabinet. Therefore, in many constructions of refrigerator cabinets, particularly using pre-painted sheet metals, it has been necessary to use a base sub-frame which fits beneath the insulation bottom panel and which also generally provides a support for the compressor and other portions of the mechanism which are generally located in a housing at the bottom rear of the cabinet and exposed to air for cooling purposes. Because a sub-frame is used, it is necessary to provide a decorative finish over the frame, either in the form of separate panels or by extending the outer sides of the cabinet surface downward over the exterior of the frame. Thus, a rather substantial and heavy sub-frame can be used within the refrigerator cabinet to provide the necessary rigidity, although the resulting construction generally has a rather high cost of manufacture.

An alternative construction which eliminates a heavy sub-frame is shown in the U.S. patent of Earl Anderson No. 3,948,410, granted Apr. 6, 1976, assigned to the assignee of the present invention and incorporated herein by reference. With this construction, the sheet metal for the outer surface of the cabinet uses a single piece to form both side walls, the top and the bottom wall, and is joined at a seam along the one bottom edge. To support the cabinet, a separate base is formed from a single piece of pre-finished material formed into a rectangle having side walls and inwardly extending flanges at the top and bottom edges. The top flanges are fastened directly to the bottom surface of the shell by mechanical fastening means, while the bottom flanges serve as a mount for leveling legs or the like to support the refrigerator cabinet and allow for the necessary leveling.

With the cabinet construction of the type described above, the base member is generally used also to support the lower hinge bracket for the door, and since doors are generally reversible to be hinged on either side, it is necessary to provide a mount for a hinge plate at each front corner of the base. To allow sufficient grip for the fastening screws, it is also necessary to provide a tapping plate on the rear or inner face of the base. Furthermore, screw-type leveling legs are generally mounted in a threaded bushing mounted on the interned lower flange, and since the thickness of the metal used for the base is generally relatively thin for easy fabrication, it is possible that continued movement of the refrigerator will cause the base to flex and cause possible misalignment of the hinge bracket or the leveling legs, therefore requiring further adjustment of these members on the refrigerator.

A popular option on refrigerators these days is to provide rollers to allow the refrigerator to be easily moved away from the wall for easy cleaning of the floor surface and rear portion of the refrigerator. For rollers to be effective in eliminating any sliding friction, it is necessary to have rollers at both the front and back corners. However, it is generally desirable to be able to disable the front rollers by retracting them and rely on a leveling leg for support when the refrigerator is in the operating position to prevent undesired movement of the refrigerator along the floor. Thus, when the roller arrangement is used, it is necessary to provide both screw-type leveling legs at each of the front corners as well as a roller assembly that can be raised or lowered with respect to the refrigerator cabinet to move it to and from an operating position.

One such arrangement is shown in the U.S. patent of Douglas E. Weaver No. 4,783,879, granted Nov. 15, 1988, assigned to the assignee of the present invention and incorporated herein by reference. In the arrangement shown in this patent, the refrigerator generally uses an elongated base rail along each side, and while the base rail can support rollers at the back, it has generally been necessary to mount adjustable rollers on a separate frame attached to the underside of the insulation bottom. With this arrangement, it is possible that if the refrigerator suffers high enough impact loads, such as being dropped so that the rollers must absorb the impact, the mounting may become distorted and the rollers less effective in operation.

SUMMARY OF THE INVENTION

The preferred embodiment of the present invention provides a bracket member adapted to fit inside the lower front corners of the refrigerator cabinet just above the floor level and below the insulation bottom cover. The bracket is generally U-shaped, with a bottom portion extending parallel to the floor and generally just above and in contact with the upper surface of an inturned flange on the refrigerator cabinet. The bend portion of the U is squared off and fits directly behind the front panel of the refrigerator cabinet, while the upper portion extends backward in abutting and supporting contact with either an inturned flange on the base of the cabinet or the insulation bottom support member. Both the top and bottom portions extend backward only a sufficient distance to accommodate their direct support function, and therefore terminate a short distance behind the front wall of the cabinet.

The vertical portion of the bracket contains tapped holes to receive the bolts for mounting the lower hinge bracket which fits on the front face of the front cabinet panel, but may be spaced therefrom by a suitable shim, as necessary. Clamping bolts extend through the hinge bracket, the shim, and the cabinet wall, and are threaded into the bracket member so that when they are tightened, all of the members are clamped together as a unitary assembly. The bracket member may be additionally secured to the cabinet by means of other fasteners, such as clamp screws that extend through the bottom flange of the refrigerator and are threaded into the bottom wall of the bracket member, and by a suitable rivet extending through the refrigerator cabinet to secure the bracket member to the cabinet front wall so that it remains in place when the screws holding the hinge member are removed if the hinge bracket is transferred to the other side of the refrigerator when door reversal is desired.

The bracket member also serves to provide a threaded engagement for a screw-type leveling leg, as well as support for a pivotally mounted roller which may be raised and lowered by a screw extending through the front face of the bracket and an opening in the front face of the cabinet and the hinge member for access from the front of the refrigerator for raising and lowering the roller as necessary.

With this arrangement, the bracket member provides a solid mounting for the screw-type leveling leg and the roller, as well as the lower hinge bracket for the door. By having these members all rigidly mounted together, the door becomes positively positioned with respect to the floor and, once leveled, is not likely to move out of adjustment. Furthermore, the support loads are transferred through the bracket member to the cabinet walls as well as to the insulation bottom member to provide greater stiffness and rigidity in this area, using a minimum of material.

DESCRIPTION OF THE PREFERRED EMBODIMENT

Figure 2:
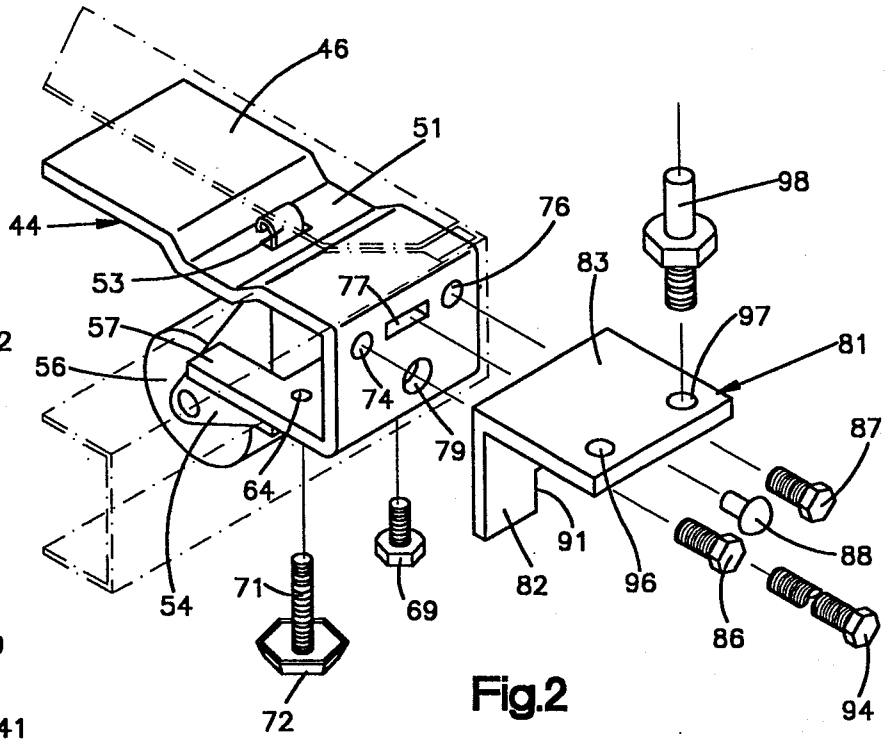
FIG. 2 is an exploded view showing the bracket member and hinge member with the refrigerator cabinet bottom frame in phantom.
Figure 1:
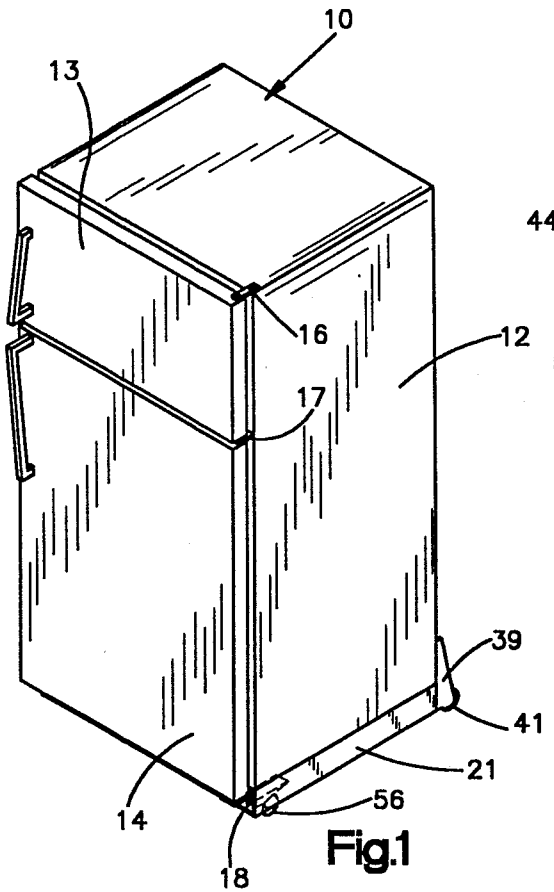
FIG. 1 is a perspective view of a two-door, top mount refrigerator incorporating the present invention.

Referring to the drawings in greater detail, FIG. 1 shows a refrigerator 10 of the two-door type having a freezer compartment at the top and a fresh food compartment at the bottom. The refrigerator includes a sheet metal shell 12 forming the top, both sides and bottom walls of the cabinet. The top freezer compartment is closed by a top door 13, while the lower fresh food compartment is closed with a bottom door 14. The refrigerator cabinet includes a top hinge member 16 which cooperates with a middle hinge member 17 to provide the hinge mountings for top door 13, while the middle hinge member 17 cooperates with a bottom hinge member 18 to provide the hinge mountings for the bottom door 14. The bottom hinge member 18 is mounted not on the shell 12 itself but rather on a separate base 21 having the same width and depth as shell 12 and secured to the bottom wall of shell 12 by suitable means (not shown). It will be understood that, except for differences described hereinafter, the shell 12 and base 21 may be constructed as shown in the aforesaid patent No. 3,948,410.

As shown in detail in the other figures, base 21 is rectangular in shape, and preferably formed from a strip of pre-painted sheet metal which is formed with inwardly projecting flanges on the top and bottom edges and bent at the four corners to form the closed rectangle where the free ends are secured together by a mechanical interlock. Thus, the base 21 has a front face 22 together with left and right side faces 23 and 24 which are generally coextensive with the adjacent surface on the shell 12, and it will be understood that base 21 also includes a rear face (not shown). The faces 22, 23 and 24 terminate along their upper edges at inwardly extending top flanges 26, 27 and 28, respectively, and these flanges are formed with mitered edges at the corners so that they do not overlap when bent through a 90° angle. The flanges 26, 27 and 28 abut against the bottom surface of the shell 12 and suitable fastening means are used between these flanges and the bottom shell to hold the base in place, and this may be done in the manner shown in the aforesaid U.S. Pat. No. 3,948,410.

Figure 3:
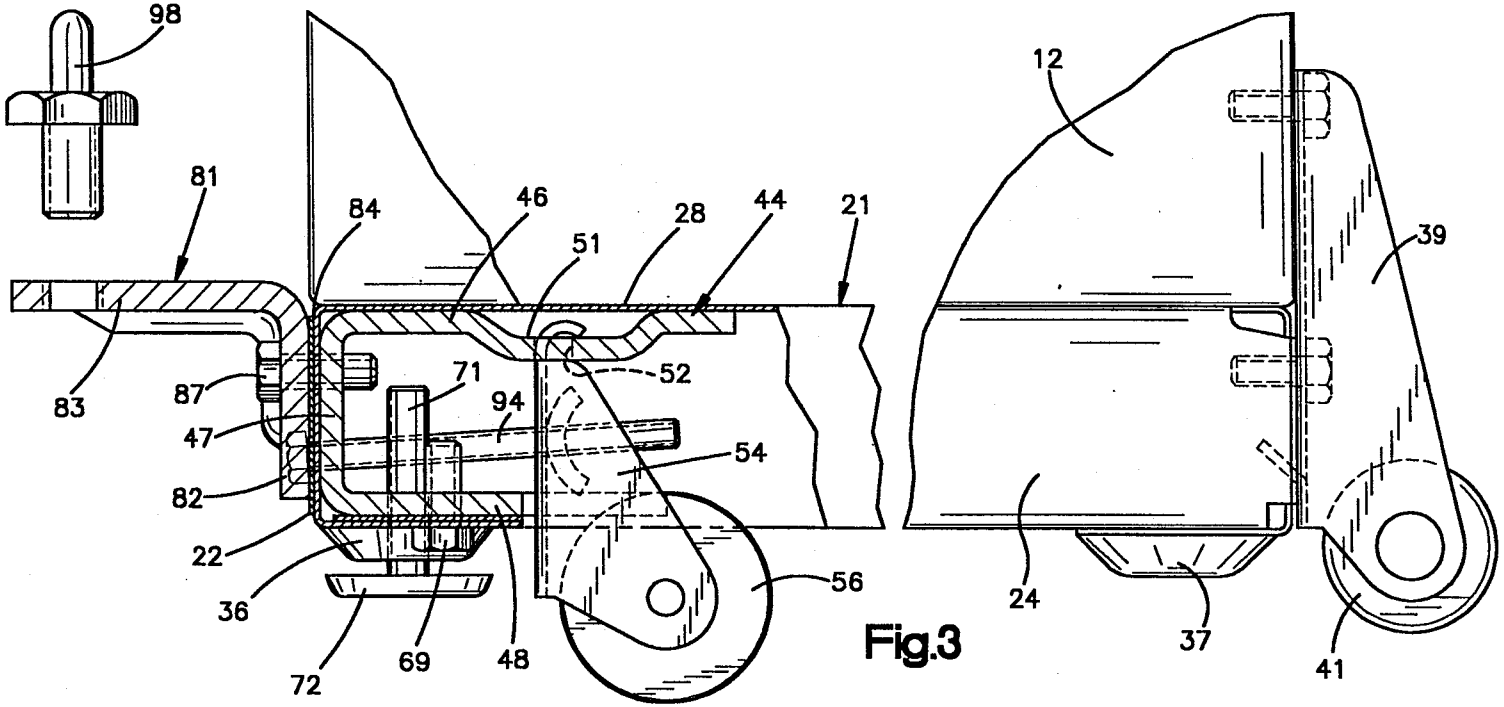
FIG. 3 is a fragmentary side elevational view of the refrigerator, with parts broken away, showing mounting details of the bracket member, hinge member, and roller assembly.
Figure 5:
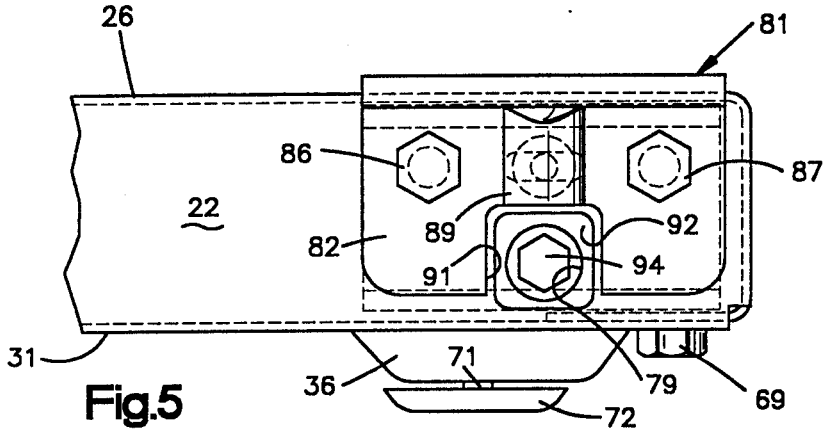
FIG. 5 is a fragmentary, elevational view of the refrigerator base member shown in FIG. 4.

The sides 22, 23 and 24 at their lower edges have integral inwardly extending bottom flanges 31, 32 and 33 respectively and these bottom flanges may form the supporting structure for the refrigerator and downwardly projecting bosses are formed at each of the four corners so that the front bottom flange 31 is formed at the left end with a left front boss 34 (see FIG. 8) and at the right end with a right front boss 36 as shown in FIG. 5. Bosses are also formed at the rear as shown at 37 in FIG. 3. As described hereinafter, the front bosses are used to mount leveling legs to permit the refrigerator to be leveled for proper door opening and to ensure that all four legs make contact with the floor surface on which the refrigerator rests. In the case that the refrigerator is provided with rollers to allow the refrigerator to be moved easily across a smooth floor surface, rear rollers may be provided in the form of a rear roller frame 39 secured to the back wall of the shell 12 and base 21 and carrying a rear roller 41. These rollers are fixed in place and when they are used the roller is so positioned that the adjacent boss 37 is spaced a distance above the floor.

The front corners of the refrigerator create a problem for mounting of the various parts that must be secured to the base 21 for proper positioning. Thus, at each front corner, it is necessary to provide a mounting arrangement for the bottom hinge 18 as well as a screw-type leveling leg and an adjustable roller assembly which allows a roller to be easily raised and lowered with respect to the base 21 and the refrigerator. The roller must be adjustable since it must be lowered to a downward position to carry the weight of the front of the refrigerator to allow the refrigerator to be supported entirely on rollers for easy movement across the floor. On the other hand, it is necessary to retract the roller so that the refrigerator is supported on an adjustable leg not only to ensure that the refrigerator can be properly leveled but also to produce the frictional engagement between the refrigerator and the floor so that it will remain stationary when no movement is intended. If all of these members are mounted directly on the base 21, it is necessary to make the entire base of a relatively heavy and thick sheet metal to give the necessary strength, and this increases cost of fabrication and material. With the present invention, it is possible to use a relatively thin material for the base 21 by providing bracket members 43 and 44 at the left and right front corners of the base. These brackets 43 and 44 can be identical in construction and may be made out of a relatively thick and strong sheet steel having sufficient strength to carry the loads of the refrigerator without distortion and of such size to allow the loads to be distributed over the rest of the cabinet with a minimum of stress concentration.

The right bracket member 44 is shown FIGS. 2–6, is substantially U-shaped with a relatively long top wall 46 which abuts against the underside of top flanges 26 and 28 to transfer the load directly between the top wall 46 and flanges 26 and 28, and hence the refrigerator cabinet itself. Bracket 44 is positioned so that a vertical front wall 47 engages the inside of the base front wall 22 at the corner while a shorter bottom wall 48 extends along the upper surfaces of bottom flanges 31 and 33 on the front and right sides of base 21. Thus bracket 44, by engaging the front wall as well as the top and bottom flanges that are adjacent to it, strengthens all of these portions and prevents any deflection of the relatively thin metal used for base 21 in these areas.

The top wall 46 has a recess 51 adjacent its midpoint which includes an opening 52 to receive the end 53 of a roller carrier 54 supporting a roller 56 adapted to make supporting engagement with the floor surface. The carrier 54 is positioned laterally by projecting arms 57 on the bottom wall 48 to positively position the roller carrier 54 when lateral loads are applied to the refrigerator cabinet. It will be understood that the roller carrier 54 and roller 56 may be constructed to be substantially identical with the arrangement disclosed in the aforesaid patent No. 4,783,879, and therefore will not be described in further detail.

Figure 4:
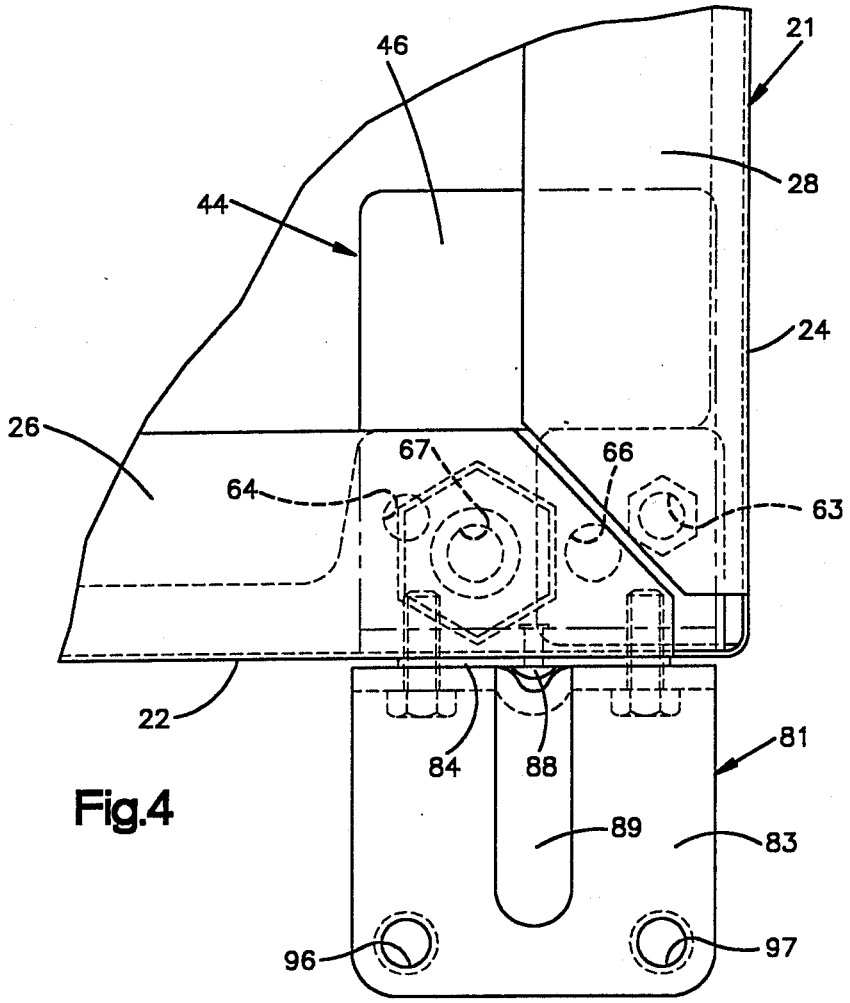
FIG. 4 is an enlarged, fragmentary top plan view of a refrigerator base member, including the bracket member and hinge bracket.
Figure 6:
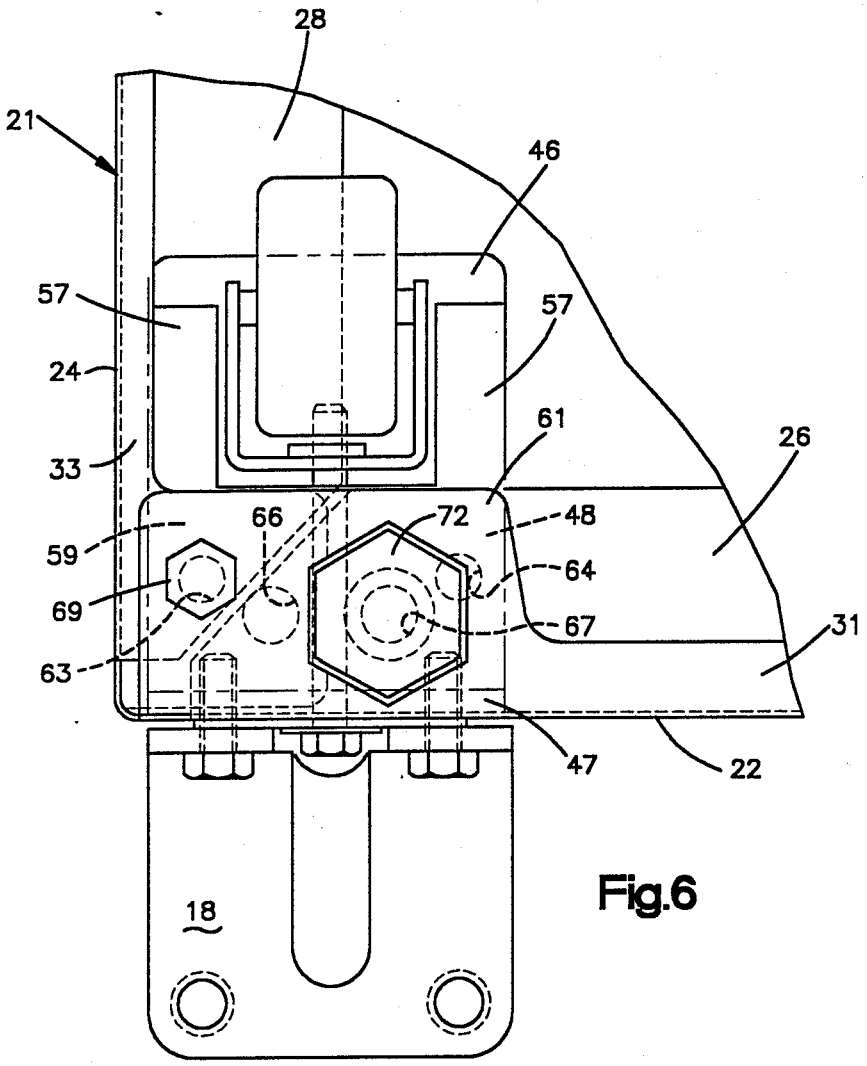
FIG. 6 is an enlarged bottom plan view of the refrigerator base member shown in FIG. 4.

While the top flanges 26–28 are formed so that there is no overlap after they have been bent into the horizontal position, to ensure a flush fit with the bottom of shell 12, the bottom flanges 31–33 do form an overlap to provide a stronger construction. Thus, the right side bottom flange 33 has a rectangular tab 59 on the upward or inward side of the base, while the front bottom flange 31 has a somewhat larger tab 61 (see FIG. 6) folded over on the outer or bottom side of tab 59, and tab 61 is formed with a width substantially equal to that of the bottom wall 48. It will be understood that the brackets 43 and 44 are symmetrical about a longitudinal center line so that they may be used interchangeably at each of the corners. Thus, as shown in FIGS. 4 and 6, the bottom wall 48 is formed with a pair of threaded outer holes 63 and 64 together with a pair of inner holes 66 and 67 slightly forward or toward the front wall 47. The outer holes 63 and 64 are located so that the hole most adjacent the side wall of the base is adapted to receive a screw 69 extending upward through the tabs 59 and 61 to make threaded engagement in the hole 63 (see FIG. 6), so that when the screw 69 is tightened it clamps the tabs 59 and 61 tightly against the bottom wall 48. A threaded leveling leg 71 having an enlarged support pad 72 is then arranged to pass through openings in the boss 36 formed on tab 61 to make threaded engagement with the threaded hole 67 to allow the leveling leg to be adjusted vertically in the conventional manner.

The front wall 47 of bracket 44 is provided with a pair of tapped holes 74 and 76 adjacent each of the upper corners and is also provided with a horizontal slot 77 in the middle between holes 74 and 76. Directly below slot 77 is an enlarged clearance hole 79, and it will be understood that each of these holes is aligned with mating holes (not shown) on the front side 22 of base 21. As shown in FIGS. 2–6, a hinge bracket 81 serves to support the bottom door 14 and forms part of the bottom hinge assembly 18. Hinge bracket 81 takes the form of an angular bracket having a vertical wall portion 82 connected to a horizontal wall portion 81 which serves to mount the hinge pin 98 in either of two positions depending upon the side of the refrigerator on which the bracket is mounted. The vertical wall portion 82 fits against the front face 22 and may be spaced therefrom by a suitable gasket or spacer 84. The vertical wall portion 82 has a pair of openings to receive a pair of hinge bracket screws 86 and 87 which engage the tapped holes 74 and 76 to rigidly hold the hinge bracket in place. A rivet 88 extends through the front face 22 and the slot 77 and serves to hold the bracket 44 in place in the event that the hinge bracket 81 and screws 86 and 87 are removed and used on the other side when the hinging of the doors is reversed. The bracket 81 includes a folded groove 89 on its upper and interior surfaces along the wall portions 82 and 83 and this groove 89 not only provides greater rigidity for the bracket but also provides a clearance over the head of rivet 88.

The vertical wall portion 82 has notch 91 formed at the center of the lower end to align with an enlarged opening 92 in the front face 22 and which also aligns with the clearance hole 79 to receive an adjusting screw 94 which extends into the interior of the bracket and is used to pivot the roller carrier 54 to raise and lower roller 56, as explained in the aforesaid patent No. 4,783,879. As shown most clearly in FIG. 2, the horizontal wall portion 83 of hinge bracket 81 has a pair of holes 96 and 97 on the outer corners which are threaded so that one or the other of the holes receives the hinge pin 98. It will be noted that with this construction the hinge pin 98 and hinge bracket 81 must support the entire load of the bottom door 14, and because of the cantilever construction of the hinge bracket, the load is transferred in tension through the screws 86 and 87 directly to the bracket 44. Since the latter is prevented from rotating by means of the engagement of the relatively long top wall 46 against the adjacent top flange 28 and the bottom of the shell 12, this arrangement provides a rigid support for the hinge bracket 81. In addition, because of the mounting of the roller carrier 54, the support forces from the roller 56 are also transferred directly to the bracket 44, as are the support forces from the leveling leg 71. Thus, the bracket 44 can be made of sufficiently heavy material to take the weight of the refrigerator as well as the forces of the hinge without distortion, and since the bracket is completely hidden behind the walls of the base 21, it need not be made of a material that has to take a decorative finish as applied to the exterior of the cabinet.

Figure 7:
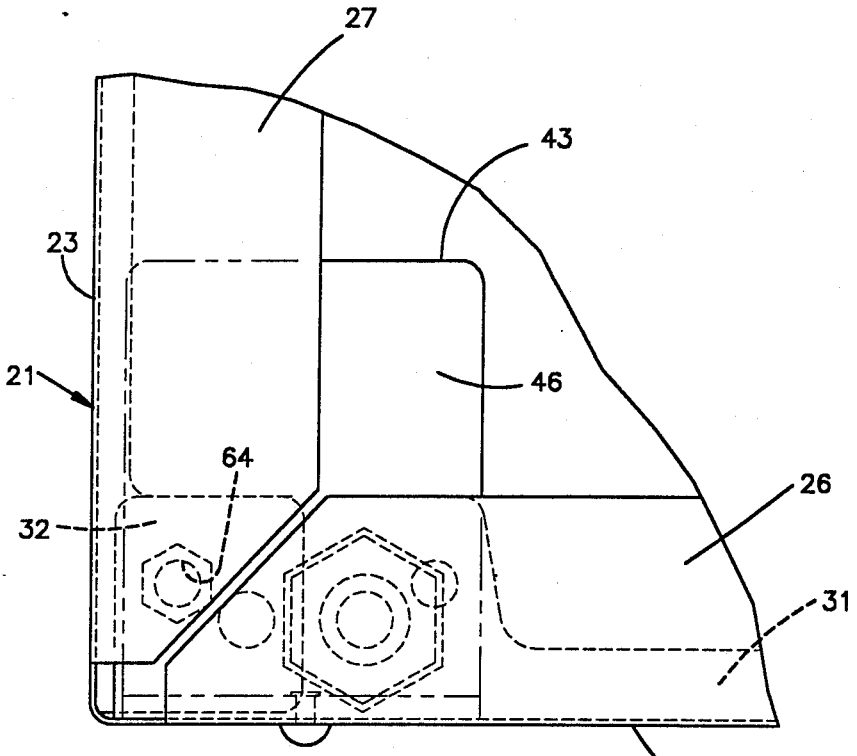
FIG. 7 is an enlarged fragmentary, top plain view of a refrigerator base member at the opposite front corner without the hinge bracket.
Figure 8:
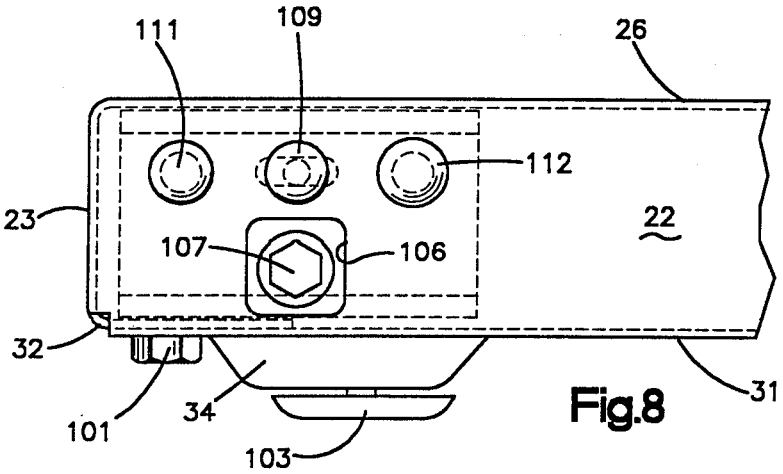
FIG. 8 is a fragmentary, elevational view of the refrigerator base member shown in FIG. 7.

As described hereinbefore, there is a bracket at each front corner of the base 21, and accordingly a left bracket 43 is positioned at the left corner as shown in FIGS. 7 and 8. It should be understood that bracket 43 is identical in every respect with bracket 44 and will therefore be described using the same reference numerals as those used in connection with bracket 44 hereinabove. The bracket 43 is positioned with its top wall 46 lying underneath the top flanges 26 and 27, while a screw 101 similar to screw 69 extends through the bottom flanges 31 and 32 to make threaded engagement with the adjacent left outer hole 64 and the right inner hole 66 receives a left leveling leg 103 extending upward through the left front boss 34. The front face 22 has an opening 106 similar to opening 92, allowing access through an adjusting screw 107 for moving the roller assembly (not shown) mounted in the left bracket 43 and identical to the one carried by the right bracket 44. A rivet 109 has a head exposed on the face 22 and extends through the bracket slot 77. Since no hinge bracket is mounted at this corner, it will be seen that the rivet 109 and screw 101 serve as the sole means to hold the bracket 43 in place within the base 21. Since the hinge bracket screws are not present, plugs 111 and 112 extend through the openings in the front 22 and the tapped holes 74 and 76 in the hinge bracket to provide a finished appearance and prevent the entry of dirt into the threaded holes which remain available in the event that the user of the refrigerator wishes to move the hinges assemblies to the left hand side from their normal position on the right hand side.

Thus, the two brackets 43 and 44 in both front corners function to stiffen the base 21 and allow it to be made of thinner pre-finished material while also providing a rigid anchor and support for the leveling legs and roller assemblies and a positive rigid anchor for the bottom hinge bracket which is subject not only to the vertical load of the weight of the door but also a lateral thrust because of the offset of the door hinge from the center of mass of the door. Not only is the bracket itself made of sufficiently heavy material to avoid deflection and distortion under the loads, but it is also firmly positioned against the inturned top and bottom flanges on the base and held in place by fasteners so that the forces applied to the bracket by the leveling legs, rollers and hinge bracket can then be transferred to the remainder of the cabinet through the base and its abutting engagement with the bottom of the refrigerator shell.

Although the preferred embodiment of this invention has been shown and described in detail, it is recognized that various modifications and rearrangements may be made without departing from the scope of the invention as defined in the following claims.

What is claimed is:

1. A refrigerator cabinet comprising an outer shell, an inner liner mounted in said shell, and insulation filling the space between said shell and said liner, said shell and said liner defining an open side, a door adapted to close said open side when said door is in the closed position, hinge means for supporting said door on said cabinet, said shell including a wall portion on said open side having an outer face and an inner face, a bracket member positioned adjacent said inner face, said hinge means including a hinge bracket positioned adjacent said outer face, fastener means interengaging said hinge bracket, said wall portion and said bracket member and clamping them together as a unit, and adjustable support means engaging said bracket member and an adjacent floor surface and being adjustable for leveling said cabinet with respect to said floor surface.

2. A refrigerator cabinet as set forth in claim 1, wherein said support means is a leveling leg making threaded engagement with said bracket member.

3. A refrigerator cabinet as set forth in claim 1, wherein said support means is a roller mounted on a roller carrier pivotally mounted on said bracket member and screw means carried by said bracket member is arranged to pivotally position said roller carrier with respect to said bracket member.

4. A refrigerator cabinet as set forth in claim 1, wherein said bracket member is mounted at one front corner of said cabinet and a second bracket member is mounted at the other front corner of said cabinet, and a second adjustable support means is in engagement with said second bracket member, said second bracket member being constructed to mount said hinge means alternatively with said first bracket member.

5. A refrigerator cabinet as set forth in claim 4, wherein said first and second bracket members are identically constructed.

6. A refrigerator cabinet comprising an outer shell having a front face and left and right side walls, said front face defining an opening, an inner liner mounted in said shell at said front face, insulation filling the space between said shell and said liner, a door adapted to close said opening when said door is in the closed position, hinge means for supporting said door on said cabinet, said shell including a base wall portion extending vertically downward below said front face and said walls, said base wall portion having an outer face and an inner face, said base wall portion having an inwardly extending flange at the lower edge, a bracket member positioned adjacent said inner front face and above said flange adjacent one of said side walls, said hinge means including a hinge bracket positioned adjacent said outer front face, fastener means interengaging said hinge bracket, said wall portion and said bracket member and clamping them together as a unit, and adjustable support means engaging said bracket member and an adjacent floor surface and being adjustable for leveling said cabinet with respect to said floor surface.

7. A refrigerator cabinet as set forth in claim 6, wherein said bracket member has a lower wall extending in abutting engagement with the upper side of said base wall flange.

8. A refrigerator cabinet as set forth in claim 7, wherein said bracket member includes an upper wall extending parallel to and a spaced distance above said lower wall.

9. A refrigerator cabinet as set forth in claim 7, wherein said adjustable support means is a threaded leveling leg making threaded engagement with said bracket member lower wall.

10. A refrigerator cabinet as set forth in claim 8, wherein said adjustable support means is a roller carrier pivotally mounted on said bracket member upper wall.

11. A refrigerator cabinet comprising an outer shell, an inner liner mounted in said shell, and insulation filling the space between said shell and said liner, said shell including a bottom wall, a base member having a vertical wall portion and upper and lower inturned flanges, means securing said upper flange to said shell bottom wall, said vertical wall portion having an outer face and an inner face, a bracket member positioned adjacent said inner face, said bracket member having an upper portion in abutting contact with said upper flange and a lower portion in contact with said lower flange, fastener means securing said bracket member to said base member and adjustable support means engaging said bracket member and an adjacent floor surface and being adjustable for leveling said cabinet with respect to said floor surface.

12. A refrigerator cabinet as set forth in claim 11, wherein said adjustable support means is a threaded leveling leg making threaded engagement with said bracket member lower portion.

13. A refrigerator cabinet as set forth in claim 12, wherein said adjustable support means also includes a roller carrier pivotally mounted on said bracket member upper portion.

14. A refrigerator cabinet comprising an outer shell having a front face and left and right side walls, said front face defining an opening, an inner liner mounted in said shell at said front face, insulation filling the space between said shell and said liner, said shell including a bottom wall, a base member having front, left and right vertically extending wall portions and upper and lower inturned flanges extending from said wall portions, means securing said upper flange to said shell bottom wall, said wall portions having an outer face and an inner face, a bracket member positioned adjacent said inner face at each front corner, each of said bracket members having an intermediate vertical portion abutting said inner face, said bracket members each having an upper portion in abutting contact with said upper flange and a lower portion in abutting contact with said lower flange, fastener means securing each of said bracket members to said base member and adjustable support means engaging each of said bracket members and an adjacent floor surface and being adjustable for leveling said cabinet with respect to said floor surface.

15. A refrigerator cabinet as set forth in claim 14, wherein said fastener means includes at least one fastener securing said base member front wall portion to the adjacent bracket member intermediate vertical portion.

16. A refrigerator cabinet as set forth in claim 14, wherein said fastener means includes a fastener extending through the adjacent lower inturned flange and engaging said bracket member lower portion.

17. A refrigerator cabinet as set forth in claim 14, wherein said cabinet includes a door adapted to close said open side when said door is in the closed position, hinge means for supporting said door on said cabinet, said hinge means including a hinge bracket secured to said base member front wall portion and said bracket member intermediate vertical portion whereby the weight of said door can be transferred from said hinge means through said bracket member to said adjustable support means.

18. A refrigerator cabinet as set forth in claim 17, wherein said hinge means may be selectively connected to either of said bracket members whereby said door may be hinged on either the left or right sides of said cabinet.

* * * * *